United States Patent [19]

Aono et al.

[11] Patent Number: 4,824,757

[45] **Date of Patent: * Apr. 25, 1989**

[54] PROCESS FOR PREPARING POSITIVE-ACTING PHOTOSENSITIVE LITHOGRAPHIC ALUMINUM PRINTING PLATE PRECURSOR USING NITRIC ACID ELECTROKYTE FOR GRAINING

[75] Inventors: Koichiro Aono; Hirokazu Sakaki, both of Shizuoka, Japan

[73] Assignee: Fuji Photo Film Co., Ltd., Kanagawa, Japan

[ * ] Notice: The portion of the term of this patent subsequent to Oct. 9, 2001 has been disclaimed.

[21] Appl. No.: 154,474

[22] Filed: Feb. 8, 1988

Related U.S. Application Data

[63] Continuation of Ser. No. 819,330, Jan. 16, 1986, abandoned, which is a continuation-in-part of Ser. No. 191,097, Sep. 26, 1980, abandoned.

[30] Foreign Application Priority Data

Sep. 27, 1979 [JP] Japan ..... 54-124513

[51] Int. Cl.[4] ..... G03C 1/94; G03C 1/54

[52] U.S. Cl. ..... 430/169; 204/17; 204/33; 204/36; 204/38.3; 204/42; 204/58; 430/165; 430/166; 430/168; 430/276; 430/278

[58] Field of Search ..... 430/169, 168, 166, 165, 430/278, 276; 204/33, 36, 38.3, 17, 42, 58

[56] References Cited

U.S. PATENT DOCUMENTS

| | | | |
|---|---|---|---|
| 3,755,116 | 8/1973 | Terai et al. | 204/33 |
| 3,834,998 | 9/1974 | Watanabe et al. | 204/33 |
| 4,116,695 | 9/1978 | Mori et al. | 430/278 |
| 4,301,229 | 11/1981 | Sakaki et al. | 430/278 |
| 4,476,006 | 10/1984 | Ohba et al. | 430/278 |

*Primary Examiner*—Charles L. Bowers, Jr.
*Attorney, Agent, or Firm*—Sughrue, Mion, Zinn, Macpeak, and Seas

[57] ABSTRACT

A process for preparing a positive-acting photosensitive lithographic printing plate precursor is described, comprising a combination of the steps of (a) electrolytically graining an aluminum plate in a nitric acid-based electrolyte, (b) etching the grained plate with an alkali, (c) anodizing the etched plate, and (d) forming a photosensitive layer containing an o-quinonediazide on the anodized plate.

8 Claims, 1 Drawing Sheet

PROCESS FOR PREPARING POSITIVE-ACTING PHOTOSENSITIVE LITHOGRAPHIC ALUMINUM PRINTING PLATE PRECURSOR USING NITRIC ACID ELECTROKYTE FOR GRAINING

This is a continuation of application Ser. No. 819,330, filed 1-16-86, now abandoned, which is a continuation-in-part of application Ser. No. 191,097, filed 9-26-80, now abandoned.

BACKGROUND OF THE INVENTION

1. Field of the Invention

This invention relates to a process for preparing a positive-acting photosensitive lithographic printing plate precursor, and, more particularly, to a process for preparing a positive-acting photosensitive lithographic printing plate precursor by electrolytically graining an aluminum plate (including an aluminum alloy plate), etching the grained plate with an alkali, and anodizing the etched plate.

2. Description of the Prior Art

Lithography is a printing method that uses the intrinsic immiscibility of water and oil. On the surface of a printing plate, an area that receives water and repels oily ink (non-image area) and an area that repels water and receives oily ink are formed. The lithographic printing plate uses an aluminum support that carries the non-image area and is required to have a high degree of hydrophilicity and water retention and provide tight adhesion with a photosensitive layer to be placed on the plate. To achieve this purpose, the surface of the aluminum support is subjected to graining (that is, the formation of fine ridges and recesses). Methods of graining include mechanical graining, such as ball graining, brush graining, and wire graining, electrolytic graining, and combinations of mechanical graining and electrolytic graining, as described in Japanese Patent Application (OPI) No. 63902/79 (the term "OPI" as used herein refers to a "published unexamined Japanese patent application"). Electrolytic graining or its combination with mechanical graining is preferred because it provides non-directional grain, and the surface obtained is uniformly grained and has high water retention.

The thus-grained aluminum surface is soft and is easily worn. Therefore, generally the aluminum plate is then anodized to provide an oxide coating on which the photosensitive layer is to be formed. The surface of the anodized aluminum plate is hard, has high wear resistance, good hydrophilicity and water retention and provides intimate contact with the photosensitive layer. However, the electrolytically grained surface may either have smut deposited thereon, or it may not be uniformly grained. For instance, if the electrolytically grained plate is immediately thereafter subjected to anodization, a black oxide coating is formed; not only does the coating reduce the aesthetic value of the plate but it also provides low or uneven sensitivity for the photosensitive layer to be formed on it. Furthermore, a developed plate has an image area that is hardly distinguishable from a non-image area, and this presents difficulties in plate finishing operations, such as deletion and image erasure, that are indispensable to a photomechanical process. In addition, the presence of smut causes a printing plate to have a very short press life if the aluminum plate is immediately anodized and is overlaid with a photosensitive layer.

In order to eliminate at least partially the above-described disadvantages, a method comprising electrolytic graining in an electrolyte of hydrochloric acid and then alkali etching has been proposed in Japanese Patent Publication No. 28123/73, and a method comprising electrolytic graining and then desmutting with sulfuric acid has been proposed in Japanese Patent Application (OPI) No. 12739/78.

According to the investigation by the present inventors, the desmutting with sulfuric acid used in the above latter method effectively removed the smut deposited on the electrolytically grained surface, but this method required a prolonged period of time for making uniform the uneven surface generated by th electrolytic graining treatment, etc. Further, when an aluminum plate was subjected to the electrolytic graining in an electrolyte of nitric acid and then to the desmutting treatment with sulfuric acid, a lithographic printing plate produced from the resulting support generated scumming in non-image areas. On the other hand, it was found that the above alkali etching method was superior to the desmutting method with sulfuric acid, since smut was effectively removed due to high solubility of aluminum in an alkali etching solution and further the surface of aluminum was rendered uniform by the alkali etching. However, the electrolytic graining in hydrochloric acid and the subsequent alkali etching resulted in excessive smoothing of the grain structure and, thus, a lithographic printing plate produced from the resulting support showed a short press life due to insufficient adhesion between the support and the photosensitive layer provided thereon. In particular, when a negative acting composition comprising a light-sensitive diazo resin as described in Japanese Patent Publication No. 28123/73 (supra) was provided as a photosensitive layer on such a support, a marked decrease in the press life was observed.

SUMMARY OF THE INVENTION

Therefore, one object of this invention is to provide a process for producing a positive-acting photosensitive lithographic printing plate precursor from which a lithographic printing plate having long press life can be prepared.

Another object of this invention is to provide a process for producing a positive-acting photosensitive lithographic printing plate precursor from which a lithographic printing plate that facilitates plate finishing operations can be prepared.

Still another object of this invention is to provide a process for producing a positive-acting photosensitive lithographic printing plate precursor having a uniform grain structure and high sensitivity.

A further object of this invention is to provide a process for producing a positive-acting photosensitive lithographic printing plate precursor having a non-image area rendered less susceptible to stain formation.

It has now been found that a positive-acting photosensitive lithographic printing plate precursor using a support composed of an aluminum plate electrolytically grained in a nitric acid-based electrolyte, followed by alkali etching and anodization provides a lithographic printing plate having high sensitivity and long press life, and which is less likely to form stain.

Thus, the characteristic feature of the process of this invention is a combination of the steps, and the process comprises a combination of the steps of (a) electrolytically graining an aluminum plate, (b) etching the grained plate with an alkali, (c) anodizing the etched plate, and (d) forming a photosensitive layer containing an o-quinonediazide on the anodized plate.

DETAILED DESCRIPTION OF THE INVENTION

Figure 1:
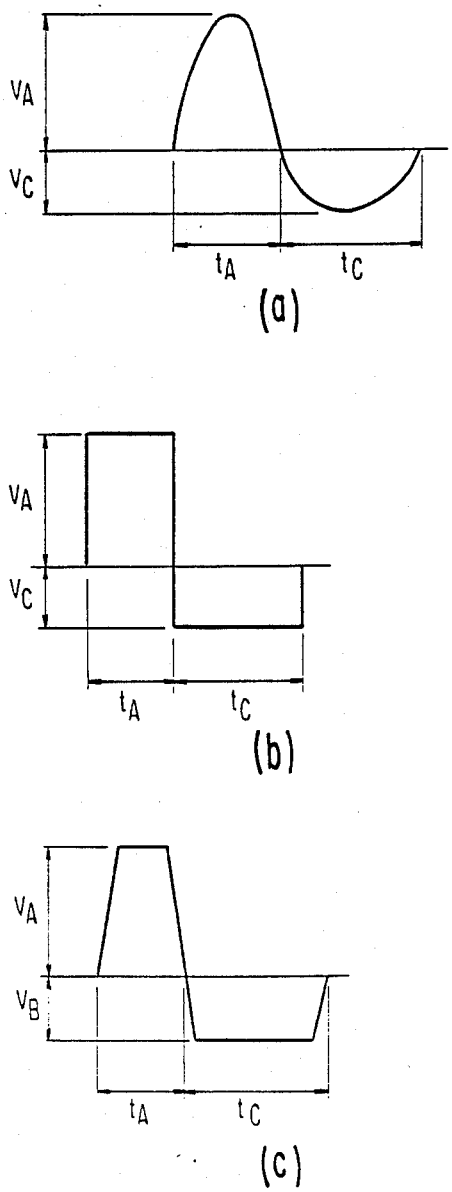
FIG. 1 shows voltage waveforms for an oscillating (alternating) current, in which (a) shows a sinusoidal wave, (b) a rectangular wave, and (c) a trapezoidal wave.

The aluminum plates that can be used in this invention include pure aluminum plates and aluminum alloy plates. Various aluminum alloys can be used, such as aluminum alloyed with silicon, iron, copper, manganese, magnesium, chromium, zinc, lead, bismuth and nickel.

Prior to electrolytic graining, the aluminum is optionally subjected to a preliminary surface treatment for the purpose of exposing a clean aluminum surface (e.g., by removing rolling oil from the surface). For the purpose of removing residual rolling oil, the surface can be washed with a solvent such as trichloroethylene or a surfactant. Further for the purpose of exposing a clean aluminum plate, an alkali etching agent such as sodium hydroxide or potassium hydroxide is generally used. Such preliminary treatment can be omitted if the electrolytic graining is preceded by mechanical graining, as described, for example, below.

In a preferred embodiment of this invention, the surface of the aluminum plate is mechanically grained prior to electrolytic graining. Mechanical graining can be performed by various methods, such as ball graining, wire graining and brush graining. Brush graining is preferred in an industrial operation. Details of a brush graining procedure are described in Japanese Patent Publication No. 46003/76 and in corresponding U.S. Pat. No. 3,891,516, and in Japanese Patent Publication No. 40047/75. The mechanical graining is preferably performed to such an extent that the resulting support for lithographic printing plate has an average surface roughness (Ra), measured by the center line method, in the range of from 0.4 to 1.0 micron.

The mechanically grained aluminum plate is preferably subjected to chemical etching. The advantages of chemical etching are that it removes any abrasive that has been deposited on or into the mechanically grained aluminum plate or excess aluminum layer and helps achieve uniform and effective electrochemical graining in the subsequent step. Details of such a chemical etching treatment are described, for example, in U.S. Pat. No. 3,834,998. Briefly, the treatment consists of immersing the aluminum plate in a solution capable of dissolving aluminum, such as an aqueous solution of acid or base. Examples of useful acids include sulfuric acid, persulfuric acid, hydrofluoric acid, phosphoric acid, nitric acid and hydrochloric acid. Examples of useful bases include sodium hydroxide, potassium hydroxide, sodium tertiary phosphate, potassium tertiary phosphate, sodium aluminate, sodium metasilicate and sodium carbonate. Aqueous solutions of base are preferred because they achieve rapid chemical etching. The aluminum plate is generally immersed in a 0.05 to 40 wt % aqueous solution of the acid or alkali for a period of from 5 to 300 seconds at a temperature from about 40° to 100° C.

Smut is generally formed on the aluminum surface when an aqueous solution of base is used for the chemical etching. If this occurs, the plate is preferably desmutted by treatment with phosphoric acid, nitric acid, sulfuric acid, or chromic acid, or a mixture of two or more of these acids.

The aluminum plate is subsequently grained in an electrolyte composed of nitric acid. Suitable methods of electrolytic graining are described in British Pat. No. 896,563 and Japanese Patent Application (OPI) No. 67507/78. The method described in Japanese Patent Application (OPI) No. 67507/78 which applies a current of special oscillating waveform through an electrolyte based on nitric acid is preferred, since it consumes less power and provides a desired grain structure.

A preferred embodiment of electrolytic graining for use in this invention is described hereunder. The "current of oscillating waveform" is obtained by alternately reversing positive and negative polarities, and it includes a single-phase A.C. current of sinusoidal waveform, three-phase A.C. current of sinusoidal waveform, and other oscillating currents of rectangular waveform and trapezoidal waveform. In the preferred embodiment of this invention, an oscillating current is applied through an aluminum plate in an acidic electrolyte in such a manner that the quantity of electricity at anode ($Q_A$) is greater than the quantity of electricity at cathode ($Q_C$). A particularly preferred ratio of $Q_C$ to $Q_A$ is from 0.3/1 to 0.95/1. It is preferred that, as described in U.S. Pat. No. 4,087,341, an oscillating current be passed through the aluminum plate at a maximum voltage as the anode greater than the maximum voltage thereof as the cathode so that the quantity of electricity at anode is greater than the quantity of electricity at the cathode. FIG. 1 shows the waveform of oscillating current that can be used in this invention; FIG. 1 (*a*) shows a sinusoidal wave, FIG. 1 (*b*) a rectangular wave, and FIG. 1 (*c*) a trapezoidal wave. In these Figures, $V_A$ stands for an anodic voltage, $V_C$ stands for a cathodic voltage, $t_A$ stands for an anodic half-cycle period and $t_C$ stands for a cathodic half-cycle period.

A voltage of from about 1 to 50 volts, and preferably from 2 to 30 volts, is applied to the aluminum plate. Current density is from about 10 to 100 amperes/dm$^2$, and preferably from 10 to 80 amperes/dm$^2$. The quantity of electricity ($Q_A$) is from about 100 to 30,000 coulombs/dm$^2$, and preferably from 100 to 18,000 coulombs/dm$^2$. The temperature of the electrolytic bath is generally from about 10° to 45° C., and preferably from 15° to 45° C. If mechanical graining precedes the electrolytic graining, the maximum quantity of electricity ($Q_A$) applied to the aluminum plate can be lower than the above-defined range, and it is preferably in the range of from 200 to 4,000 coulombs/dm$^2$.

Conventional nitric acid electrolytes can be used in the electrolytic graining of this invention. Such electrolytes are preferably used at a concentration in the range of from about 0.5 wt % to 5 wt %. They may optionally contain a corrosion inhibitor (or a stabilizer) such as nitrate salts, chlorides, monoamines, diamines, aldehydes, phosphoric acid, chromic acid and boric acid.

To remove smut, the electrolytically grained surface is lightly etched with an alkali. Excessive alkali etching destroys the grain and this results not only in the loss of improved water retention but also in short press life. However, the surface that has been electrolytically grained with a nitric acid electrolyte can be desmutted by alkali etching without risking short press life. It is presumed that because the surface electrolytically grained in the nitric acid electrolyte has three layers of uniform grain as described in Japanese Patent Application (OPI) No. 67507/78, some destruction of the grain as a result of desmutting by alkali etching does not shorten the press life.

Desmutting of the electrolytically grained surface by alkali etching can be performed very rapidly. Industrial desmutting with sulfuric acid is not only costly but also impractical because there are very few materials available that are resistant to sulfuric acid used in high concentrations and at high temperatures. Alkali etching has no such disadvantages.

The surface grained electrolytically in an electrolyte comprising hydrochloric acid cannot be desmutted by alkali etching without experiencing a greatly reduced press life. This is presumably because unlike nitric acid, hydrochloric acid used as an electrolyte does not provide a uniform grain in three layers having fine ridges and recesses.

Illustrative etchants for use in alkali etching are sodium hydroxide, potassium hydroxide, sodium tertiary phosphate, potassium tertiary phosphate, sodium aluminate, sodium metasilicate and sodium carbonate. The alkali etching is generally performed for a period of from one to sixty seconds at 20° to 80° C. using a 0.5 to 40 wt % aqueous solution of the alkali etchant. The grained surface is dissolved by an alkali in an amount of, preferably, from 0.1 to 4 g/m$^2$, and particularly preferably from 0.5 to 3.0 g/m$^2$. If more than 4 g/m$^2$ of the surface is dissolved, the press life is appreciably shortened.

For the purpose of removing the insoluble residue resulting from alkali etching and for neutralizing the alkali used, any insoluble matter on the etched surface is preferably removed by treating the surface with phosphoric acid, nitric acid, sulfuric acid or chromic acid or a mixture of two or more of these acids.

The etched aluminum plate can then be anodized by any conventional method used in the art. More particularly, an anodized coating can be performed on the surface of the aluminum support by applying either A.C. current or D.C. current through the aluminum plate in either an aqueous or non-aqueous solution of sulfuric acid, phosphoric acid, chromic acid, oxalic acid, sulfamic aid, benzenesulfonic acid or a mixture of two or more of these acids. Universal optimum conditions cannot be set forth for the anodization, since the optimum conditions vary with the particular electrolyte used, but typically, the concentration of the electrolyte is from 1 to 80 wt %, its temperature from 5° to 70° C., the current density from 0.5 to 60 amperes/dm$^2$, the voltage from 1 to 100 volts, and the time of electrolysis from 30 seconds to 50 minutes. Particularly preferred anodization methods are described in British Pat. No. 1,412,768 wherein current of high density is applied in sulfuric acid, and in U.S. Pat. No. 3,511,661 wherein phosphoric acid is used as an electrolytic bath.

The anodized aluminum plate should not be treated either with an alkali metal silicate as described in U.S. Pat. Nos. 2,714,066 and 3,181,461 or with alkali zirconium fluoride as described in U.S. Pat. No. 3,160,506. The plate also should not be overlaid with a subbing layer of hydrophilic polymer as described in U.S. Pat. No. 3,860,426.

A photosensitive lithographic print plate precursor can be prepared from the thus-prepared support for lithographic printing plate by forming a photosensitive layer conventionally known for use in a presensitized (PS) plate. When the precursor goes through a photomechanical process, a lithographic printing plate having good performance can be obtained.

The photosensitive layer is a composition containing an o-quinonediazide compound. Preferred o-quinonediazide compounds are o-naphthoquinonediazide compounds as described in U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709, 3,647,443, and many other publications. All of these compounds can be used in this invention with advantage. Particularly preferred are o-naphthoquinonediazide sulfonic acid ester or o-naphthoquinonediazide carboxylic acid ester of aromatic hydroxy compounds as well as o-naphthoquinonediazide sulfonic acid amide or o-naphthoquinonediazide carboxylic acid amide of aromatic amino compounds. Especially effective compounds are a condensate of pyrogallol and acetone esterified with o-naphthoquinonediazide sulfonic acid as described in U.S. Pat. No. 3,635,709; a polyester having a terminal hydroxyl group esterified with o-naphthoquinonediazide sulfonic aid or o-naphthoquinonediazide carboxylic acid as described in U.S. Pat. No. 4,028,111; a homopolymer of p-hydroxystyrene or a copolymer thereof with another copolymerizable monomer esterified with o-naphthoquinonediazide sulfonic acid or o-naphthoquinonediazide carboxylic acid as described in U.S. Pat. No. 4,139,384.

These o-quinonediazide compounds may be preferably used in admixture with an alkali-soluble resin. Suitable alkali-soluble resins include phenolic novolak resins illustrated by phenol-formaldehyde resin, o-cresol-formaldehyde resin, and m-cresol-formaldehyde resin. Preferably, as described in U.S. Pat. No. 4,123,279, such phenolic resins are used in combination with a condensate of phenol or cresol with formaldehyde substituted by an alkyl group having from 3 to 8 carbon atoms, such as t-butyl-phenol-formaldehyde resin. The alkali-soluble resin is contained in the photosensitive resist forming composition in an amount of from about 50 to about 85 wt %, preferably from 60 to 80 wt %, based on the total weight of the composition.

The photosensitive composition containing the o-quinonediazide compound may optionally contain a pigment, dye or plasticizer.

The photosensitive lithographic printing plate precursor thus-prepared can be exposed imagewise to a mercury lamp or metal halide lamp, and processed in an alkaline developer (mainly comprising sodium silicate) to form a lithographic printing plate.

This invention is now described in greater detail by reference to the following examples which are given here for illustrative purpose only and are by no means intended to limit the scope of the invention. In the examples, unless otherwise specified, all percents are by weight.

EXAMPLE 1

An aluminum plate 0.24 mm thick was grained with a nylon brush and a water suspension of pumice stone of 400 mesh. A substrate (I) was prepared by washing the plate thoroughly with water. The substrate was etched by immersion in 10% sodium hydroxide at 70° C. for 20 seconds. After washing with running water, the substrate was neutralized with 20% $HNO_3$ and washed with water. The substrate was then electrolytically grained in a 0.7% aqueous solution of nitric acid using an oscillating current of a rectangular waveform as shown in FIG. 1 (*b*). The conditions for electrolytic graining were $V_A=23.3$ volts, $V_C=12.0$ volts, $Q_C/Q_A=0.71$, and quantity of electricity at anode=400 coulombs/dm$^2$. The substrate was washed with water to prepare a substrate (II). The substrate (II) was treated with a 10% aqueous solution of sodium hydroxide to dissolve 1.3 g of aluminum per square meter of the surface. After washing with water, the substrate was desmutted by neutralization in 20% nitric acid and washing. The substrate was then anodized in an 18% aqueous solution of sulfuric acid to form 3 g of an oxide coating per square meter of the surface.

The resulting aluminum plate was coated with a liquid photosensitive composition of the formulation indicated below. After drying, 2.5 g of a photosensitive layer was formed per square meter.

| | |
|---|---|
| Condensate of pyrogallol and acetone esterified with naphthoquinone-1,2-diazide-5-sulfonyl chloride (described in Example 1 of U.S. Pat. No. 3,635,709) | 0.75 g |
| Cresol novolak resin | 2.00 g |
| Oil Blue #603 (product of Oriental Chemical Industry Co., Ltd.) | 0.04 g |
| Ethylene dichloride | 16 g |
| 2-Methoxyethyl acetate | 12 g |

The thus-prepared photosensitive lithographic printing plate precursor was set in a vacuum print frame and exposed for 50 seconds through a transparent positive film to a Fuji Film PS light (sold by Fuji Photo Film Co., Ltd. having as a light source a Toshiba metal halide lamp MU 2000-2-D, 3 kw) placed one meter away. The precursor was developed with a 5.26% aqueous solution (pH=12.7) of sodium silicate wherein the molar ratio of $SiO_2$ to $Na_2O$ was 1.74:1, and gummed with an aqueous solution of gum arabic (14° Be). Printing was performed with the resulting lithographic printing plate according to the conventional procedure. The results are shown in Table 1 below.

COMPARATIVE EXAMPLE 1

A substrate the same as the substrate (II) prepared in Example 1 was desmutted in a 20% aqueous solution of sulfuric acid for 40 seconds at 50° C. Thereafter, the substrate was anodized to form 3.0 g of an oxide coating per square meter. The procedure of Example 1 was repeated to prepare a lithographic printing plate precursor which was exposed and developed as in Example 1 to form a lithographic printing plate. The results of printing with the lithographic printing plate are also indicated in Table 1 below.

EXAMPLE 2

A substrate the same as the substrate (II) prepared in Example 1 was etched in a 10% aqueous solution of sodium hydroxide to dissolve 4.0 g of aluminum per square meter. After desmutting in 20% aqueous nitric acid, the substrate was anodized to form 3.0 g of an oxide coating per square meter. The procedure of Example 1 was repeated to prepare a lithographic printing plate. The results of printing with the plate are also shown in Table 1 below.

COMPARATIVE EXAMPLE 2

A substrate identical with the substrate (I) prepared in Example 1 was etched in a 10% aqueous solution of sodium hydroxide to dissolve 2.0 g of aluminum per square meter. After desmutting in 20% aqueous nitric acid, the substrate was anodized to form 3.0 g of an oxide coating per square meter. The procedure of Example 1 was repeated to prepare a lithographic printing plate. The results of printing with the plate are also shown in Table 1 below.

COMPARATIVE EXAMPLE 3

An aluminum plate 0.30 mm thick was A.C. electrolyzed in an aqueous solution containing 3.7 g of hydrochloric acid per liter and 5 g of aluminum chloride per liter. The current density was 15 amperes/dm$^2$, the voltage was 40 volts, and the electrolysis time was one minute. The plate was washed with running water to make a substrate (III). The substrate was etched in a 10% aqueous solution of sodium hydroxide until 2 g of aluminum was dissolved per square meter. After desmutting and washing with water, the substrate was immersed in 20% nitric acid for a period of one minute to neutralize and remove any excess alkali. Following washing with water, the substrate was anodized in 15% sulfuric acid to form 3.0 g of an oxide coating per square meter. The procedure of Example 1 was repeated to form a lithographic printing plate. The results of printing with the plate are shown in Table 1 below.

TABLE 1

| | Example 1 | Comparative Example 1 | Example 2 | Comparative Example 2 | Comparative Example 3 |
|---|---|---|---|---|---|
| Substrate | (II) | (II) | (II) | (I) | (III) |
| Alkali etching | 1.3 g/m$^2$ | desmutting with $H_2SO_4$ | 4.0 g/m$^2$ | 2.0 g/m$^2$ | 2 g/m$^2$ |
| Desmutting | desmutted | not desmutted | desmutted | desmutted | desmutted |
| Anodization | 3.0 g/m$^2$ | 3.0 g/m$^2$ | 3.0 g/m$^2$ | 3.0 g/m$^2$ | 3.0 g/m$^2$ |
| Press life (in sheets) | 100,000 | 100,000 | 100,000 | 100,000 | 60,000 |
| Unevenness on the surface | absent | present | absent | absent | absent |
| Resistance to stain formation on non-image area | excellent | good | excellent | fair | excellent |

Excellent: Stain not formed upon printing after extreme squeegeeing of dampening water.
Good: Stain not formed upon printing after some squeegeeing of dampening water.
Fair: Stain formed upon printing after slight squeegeeing of dampening water.

As is clear from the data in Table 1, a positive-acting lithographic printing plate precursor using an aluminum support that is prepared by electrolytic graining in a nitric acid-based electrolyte, etching with an alkali, optionally desmutting, and anodizing forms a lithographic printing plate having long press life and high resistance to stain formation.

EXAMPLE 3

An aluminum plate (JIS A1050) of 0.24 mm thick was (1) mechanically grained with a nylon brush while pouring a water suspension of pumice of 400 mesh. After washing the plate thoroughly with water, the plate was (2) alkaline-etched by immersion in 10% aqueous sodium hydroxide at 70° C. for 20 seconds. After washing with running water, the plate was neutralized with 20% nitric acid and washed with water. The plate was then (3) electrolytically grained in a 0.7% hydrochloric acid solution using an oscillating current of a rectangular waveform as shown in FIG. 1 (*b*). The conditions for electrolytic graining were $V_A=23.3$ volts, $V_C=12.0$ volts, $Q_C/Q_A=0.71$, and quantity of electricity at anode=200 coulombs/dm$^2$. After washing with water, the plate was (4) etched with a 10% aqueous solution of sodium hydroxide to dissolve 1.3 g of aluminum per square meter of the surface. After washing with water, the substrate was cleaned by neutralization in 20% nitric acid and washing. The plate was then (5) anodized in a 18% aqueous solution of sulfuric acid to form 3 g of an oxide coating per square meter of the surface, thereby obtaining Lithographic Support A.

Each of the resulting Lithographic Plates was coated with a photosensitive solution of the formulation indicated below. After drying, 2.5 g of a photosensitive layer was formed per square meter.

| | |
|---|---|
| Condensate of pyrogallol and acetone esterified with naphthoquinone-1,2-diazide-5-sulfonyl chloride (described in Example 1 of U.S. Pat. No. 3,635,709) | 0.75 g |
| Cresol novolak resin | 2.00 g |
| Oil Blue #603 (product of Oriental Chemical Industry Co., Ltd.) | 0.04 g |
| Ethylene dichloride | 16 g |
| 2-Methoxyethyl acetate | 12 g |

The thus-prepared photosensitive lithographic printing plate precursor was set in a vacuum print frame and exposed for 50 seconds through a transparent positive film to a Fuji Film PS light (sold by Fuji Photo Film Co., Ltd. having as a light source a Toshiba metal halide lamp MU 2000-2-DL, 3 kw) placed 1 meter away. The precursor was developed with a 5.26% aqueous solution (pH=12.7) of sodium silicate wherein the molar ratio of $SiO_2$ to $Na_2O$ was 1.74:1, and gummed with an aqueous solution of gum arabic (14° Be). Printing was performed with the resulting lithographic printing plate according to the conventional procedure. The results are shown in Table 2 below.

TABLE 2

| | Lithographic Support | | | | |
|---|---|---|---|---|---|
| | Comparison | | | Invention | |
| | A | B | C | D | E |
| (1) Mechanical graining | Subjected | Subjected | Subjected | Subjected | Subjected |
| (2) Alkaline-etching | Subjected | Subjected | Subjected | Subjected | Subjected |
| (3) Electrolytic graining (electrolyte) | Subjected (HCl) | Subjected (HCl) | Subjected (HCl) | Subjected ($HNO_3$) | Subjected ($HNO_3$) |
| (4) Etching with alkali (dissolved amount: (g/m$^2$) | Subjected (1.3) | Subjected (2.0) | Subjected (4.0) | Subjected (1.3) | Subjected (2.0) |
| (5) Anodizing | Subjected | Subjected | Subjected | Subjected | Subjected |
| Press life (thousand sheets) | 20 | 60 | 40 | 100 | 100 |
| Evenness of the surface of support* | Poor | Good | Good | Good | Good |
| Scumming*, ** | Poor | Excellent | Excellent | Excellent | Excellent |

*Determined by the naked eye.
**The scumming was determined as follows:
Excellent: Stain not formed upon printing after extreme squeegeeing of dampening water.
Good: Stain not formed upon printing after some squeegeeing of dampening water.
Poor: Stain formed upon printing after slight squeegeeing of dampening water.

Lithographic Support B was prepared in the same manner as described for Lithographic Support A except that the etching in the above step (4) was conducted so as to dissolve 2.0 g of aluminum per square meter of the surface.

Further, Lithographic Support C was prepared in the same manner as described for Lithographic Support A except that the electrolytic graining in the above step (3) was conducted in a 0.7% aqueous solution of nitric acid.

Furthermore, Lithographic Support D was prepared in the same manner as described for Lithogaphic Support A except that the etching in the above step (4) was conducted so as to dissolve 2.0 g of aluminum per square meter and the electrolytic graining in the above step (3) was conducted in a 0.7% aqueous solution of nitric acid.

As is apparent from the results shown in Table 2, the plate prepared by using hydrochloric acid as an electrolytic solution in the electrolytic graining has a shorter press life as compared with the plate prepared by using nitric acid.

EXAMPLE 4

Each of Lithographic Supports F, G, H, I and J was prepared in the same manner as described in Example 3 except that the mechanical graining was not performed and the electrolytic graining was conducted under the condition that the quantity of electricity at anode was 400 coulombs/dm$^2$.

A printing plate was prepared in the same manner as described in Example 3 from the resulting support, and its property was evaluated as in Example 3. The results obtained are shown in Table 3.

TABLE 3

| | Lithographic Support | | | | |
|---|---|---|---|---|---|
| | Comparison | | | Invention | |
| | F | G | H | I | J |
| (1) Mechanical graining | Not subjected | Not subjected | Not subjected | Not subjected | Not subjected |
| (2) Alkaline-etching | Subjected | Subjected | Subjected | Subjected | Subjected |
| (3) Electrolytic graining (electrolyte) | Subjected (HCl) | Subjected (HCl) | Subjected (HCl) | Subjected ($HNO_3$) | Subjected ($HNO_3$) |
| (4) Etching with alkali (dissloved amount): ($g/m^2$) | Subjected (1.3) | Subjected (2.0) | Subjected (4.0) | Subjected (1.3) | Subjected (2.0) |
| (5) Anodizing | Subjected | Subjected | Subjected | Subjected | Subjected |
| Press life (thousand sheets) | 20 | 60 | 40 | 100 | 100 |
| Evenness of the surface of support | Poor | Good | Good | Good | Good |
| Scumming | Poor | Excellent | Excellent | Excellent | Excellent |

As is apparent from the results shown in Table 3, the support prepared by using nitric acid as an electrolyte in the electrolytic graining according to the present invention is markedly superior to the supports prepared by using hydrochloric acid, even when the plate is not subjected to the mechanical graining.

While the invention has been described in detail and with reference to specific embodiments thereof, it will be apparent to one skilled in the art that various changes and modifications can be made therein without departing from the spirit and scope thereof.

What is claimed is:

1. A process for preparing a positive-acting photosensitive lithographic printing plate precursor consisting essentially of the steps (a) electrolytically graining an aluminum plate in an aqueous electrolyte consisting essentially of nitric acid, (b) etching the grained plate with an alkali to dissolve the grained surface of the aluminum plate in an amount of from 0.5 to 3.0 g of aluminum per square meter of the surface, (c) anodizing the etched plate with an aqueous solution of sulfuric acid using D.C. current, and (d) forming a photosensitive layer containing an o-quinonediazide on the anodized plate.

2. A process for preparing a printing plate precursor as in claim 1 wherein prior to step (a) the surface of the aluminum plate is mechanically grained.

3. A process for preparing a printing plate precursor as in claim 2 wherein the plate is mechanically grained by brush graining.

4. A process for preparing a printing plate precursor as in claim 1, 2, or 3 wherein the anodized plate has an average surface roughness (Ra) of from 0.4 to 1.0$\mu$.

5. A process for preparing a printing plate precursor as in claim 2 or 3 wherein the mechanically grained aluminum plate is subjected to chemical etching prior to step (a).

6. A process for preparing a printing plate precursor as in claim 5 wherein an aqueous solution of base is used for the chemical etching, and then, prior to conducting step (a), the plate is desmutted by treatment with phosphoric acid, nitric acid, sulfuric acid, or chromic acid, or a mixture thereof.

7. A process for preparing a printing plate precursor as in claim 1, 2, or 3 wherein the aqueous electrolyte consisting essentially of nitric acid used in step (a) contains a corrosion inhibitor.

8. A process for preparing a printing plate precursor as in claim 7, wherein the corrosion inhibitor comprises a nitrate salt, a chloride salt, a monoamine compound, a diamine compound, and aldehyde, phosphoric acid, chromic acid, or boric acid.

* * * * *